United States Patent [19]

Henry

[11] Patent Number: 4,715,495

[45] Date of Patent: Dec. 29, 1987

[54] DISPOSAL KIT

[76] Inventor: Herbert W. Henry, 4 West St., Cambridge, Mass. 02139

[21] Appl. No.: 921,430

[22] Filed: Oct. 22, 1986

[51] Int. Cl.[5] ..... B65D 69/00

[52] U.S. Cl. ..... 206/223; 229/52 B; 220/94 A; 294/1.3; 294/55

[58] Field of Search ..... 206/223, 466; 294/1.3, 294/25, 55, 1.1, 1.4, 19.1; 229/52 B; 383/25, 119; 220/94 A

[56] References Cited

U.S. PATENT DOCUMENTS

| | | | |
|---|---|---|---|
| 2,330,311 | 9/1943 | Pierce | 383/119 |
| 2,463,992 | 3/1949 | Moore | 206/466 |
| 2,745,545 | 5/1956 | Dunning | 206/466 |
| 3,286,826 | 11/1966 | Stoll | 294/1.3 |
| 3,815,809 | 6/1974 | Walters | 229/52 B |
| 3,833,249 | 9/1974 | McKinney, II | 294/1.3 |
| 4,017,015 | 4/1977 | Jefferson | 229/52 B |
| 4,138,153 | 2/1979 | Brown | 294/1.3 |
| 4,154,389 | 5/1979 | Dell'Anno | 294/1.3 |
| 4,155,581 | 5/1979 | Kanaga | 294/1.3 |
| 4,186,955 | 2/1980 | Campbell | 206/223 |
| 4,205,869 | 6/1980 | Mathis | 206/223 |
| 4,222,598 | 9/1980 | Ullger | 229/138 |
| 4,284,205 | 8/1981 | Hirata | 229/52 B |
| 4,635,843 | 1/1987 | Tomlinson | 294/55 |

FOREIGN PATENT DOCUMENTS

| | | | |
|---|---|---|---|
| 1444285 | 7/1976 | Fed. Rep. of Germany | 206/466 |
| 1435369 | 5/1976 | United Kingdom | 206/466 |

*Primary Examiner*—David T. Fidei

*Attorney, Agent, or Firm*—Robert T. Gammons

[57] ABSTRACT

A disposable kit for picking up animal litter in the form of a foldable paper bag secured at one side to a stiff paperboard panel such as to stiffen the side and, hence, enable firmly holding the open end of the bag engaged with the surface from which the litter is to be removed and a scoop in the form of a stiff paperboard panel for sweeping the litter into the distended open end of the bag.

1 Claim, 7 Drawing Figures

DISPOSAL KIT

BACKGROUND OF THE INVENTION

Disposable containers for scooping up and retaining animal litter are disclosed in the following patents.

4,186,955
4,103,952
4,205,869
4,017,015
4,458,932
3,345,670
4,272,116
4,155,581

In each instance, the structure is somewhat complicated and, hence, expensive to manufacture. It is the purpose of this invention to provide a simplified structure which is inexpensive to manufacture, which can be used with animal contact with the litter to be disposed of, and which can be stored in a waterproof envelope preparatory to disposal.

SUMMARY OF THE INVENTION

As herein illustrated, the disposable kit for picking up animal litter and disposing of the same according to this invention comprises a stiff panel of generally rectangular configuration, a foldable paper bag adhered to one surface of the panel such as to be collapsible into parallel coextensive relation to the panel prior to use and to be distended for use with the open end adjacent one end of the panel, means at the other end of the panel for holding the bag when distended in engagement with a surface on which the litter rests to receive the litter and a paddle comprised of a stiff paperboard for scraping the litter into the open end of the distended bag. The stiff panel is desirably comprised of cardboard, for example, corrugated board, and the bag is a paper bag. The paper bag is of the foldable kind wherein the bottom is foldable relative to the sides into parallel relation with the sides. The side opposite the folded bottom is adhesively secured to the panel. The means for holding the bag while distended comprises a pair of tabs severed from the panel along a line parallel to the bottom of the bag and foldable at an angle to the panel to provide finger grips. The kit includes a sanitary bag of disposable material within which the kit can be deposited, together with the litter, following ues and secured in anticipation of disposal.

The invention will now be described in greater detail with reference to the accompanying drawings, wherein.

Figure 1:
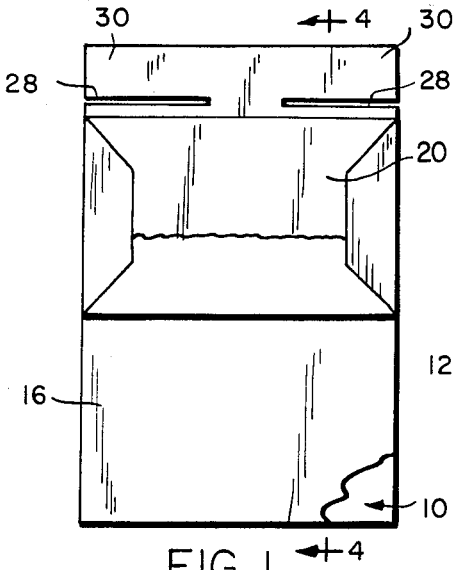
FIG. 1 is a plan view of the kit from the front or top side.
Figure 2:
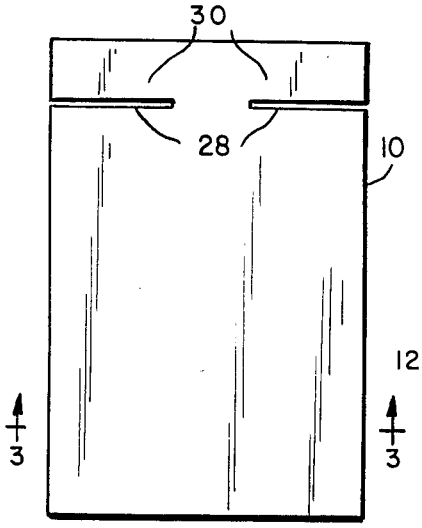
FIG. 2 is a plan view of the kit as seen from the bottom or back side.
Figures 3, 4:
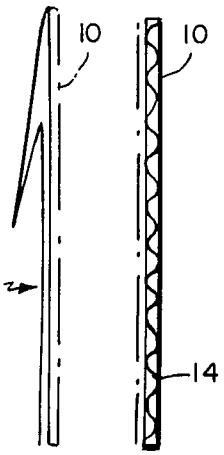
FIG. 3 is a transverse section taken on the line 3—3 of FIG. 2.
FIG. 4 is a longitudinal section taken on the line 4—4 of FIG. 1.

Referring to FIGS. 1 and 2, there is shown a substantially rectangular panel 10, to one side of which is adhesively attached a folded paper bag 12. Desirably, the panel 10 is comprised of corrugated board 14, FIG. 3, to provide for stiffness. The paper bag 12 is of conventional construction comprising two broad sides 16—16, two narrow sides 18—18, and a bottom 20 so arranged that the board sides may be folded into parallel engagement with each other and the bottom side into engagement with one of the broad sides. The bag thus folded is adhesively attached to the front face of the panel 10 with the mouth 22 of the bag adjacent one end 24 of the panel and with the folded bottom spaced from the opposite end 26 of the panel. Slots 28—28 are formed in the panel adjacent the folded end of the bag defining tabs 30—30 which are foldable relative to the inner ends of the slots 28—28 upwardly from the panel to a position to be grasped.

Figure 5:
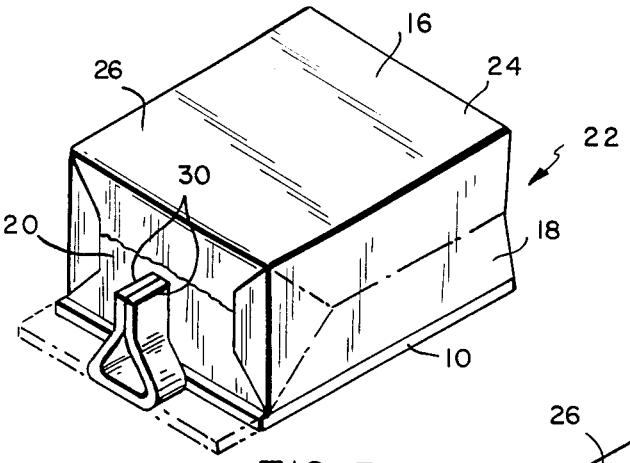
FIG. 5 is a perspective of the kit with the bag distended as seen from the rear end.
Figure 6:
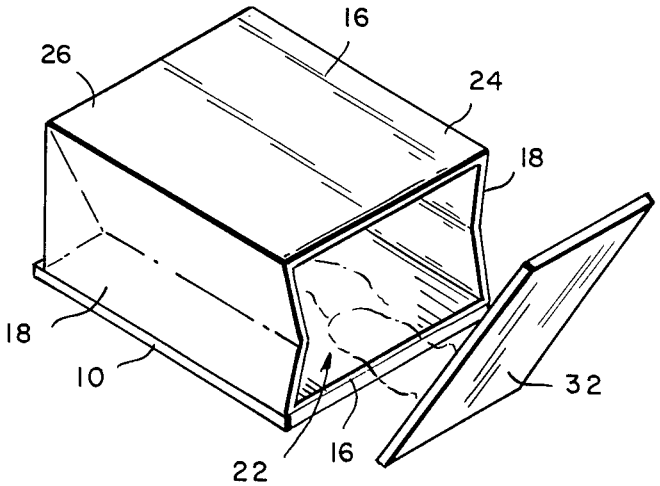
FIG. 6 is a perspective of the kit distended as seen from the front side.

As thus structured, the bag can be unfolded relative to the panel, as shown in FIGS. 5 and 6, and the tabs can be erected to enable holding the distended bag with its open end in a position engaged with a surface on which there is litter for receiving the litter. As shown in FIG. 6, a paddle 32 of stiff cardboard is provided for the purpose of pushing the litter into the open end of the bag. Desirably, the panel 10 is of such stiffness as to enable holding it firmly on the surface while the litter is being pushed into the open end of the bag.

Figure 7:
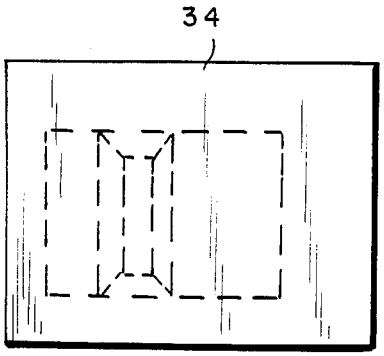
FIG. 7 is a plan view of the kit disposed in a sanitary bag.

A sanitary bag 34, FIG. 7, of flexible plastic is provided for receiving the collapsed kit prior to use, together with the paddle and, desirably, a napkin. The bag 34 should be of sufficient capacity to not only contain the kit while collapsed, but also after it has been used and is partly distended by the contents. A conventional tie may be applied to the mouth of the bag after the kit has been disposed therein.

The panel 10 and bag 12 may be inexpensively manufactured of paper material, whereas the enclosure is desirably comprised of a waterproof plastic material.

It should be understood that the present disclosure is for the purpose of illustration only and includes all modifications or improvements which fall within the scope of the appended claims.

What is claimed is:

1. A disposable kit for picking up animal litter and disposing of the same, comprising, in combination, a stiff cardboard panel of rectangular configuration, a foldable paper bag of the kind wherein the bottom is foldable relative to the sides into parallel relation therewith, said foldable paper bag being attached to one surface of the panel such as to be collapsible into parallelism with the panel prior to use and to be distendible for use with the open end adjacent one end of the panel, said panel being of a length such as to extend from the open end of the bag to and beyond the closed end of the bag and defining at the closed end of the bag an extension of a width corresponding to the width of the bag, said extension containing slits parallel to the closed end of the bag extending from the opposite edges of the panel toward the center, but terminating short of the center such as to define a pair of tabs connected to the panel and foldable relative to the panel along lines parallel to the closed end of the bag to positions generally perpendicular to the panel and at right angles to the bottom of the bag, said tabs, when folded, providing a handle for holding the bag in a position to receive the litter, a flat cardboard panel corresponding to substantially the transverse width of the bag for scooping litter into the open end of the distended bag and a sanitary bag within which the collapsed bag and scoop can be stored prior to use and disposed of after use.

* * * * *